US007390291B2

(12) United States Patent
Chiu Chen

(10) Patent No.: US 7,390,291 B2
(45) Date of Patent: Jun. 24, 2008

(54) APPARATUS FOR RAPIDLY EXPANDING AND FOLDING CARDBOARD BOXES

(75) Inventor: Tuan-Mei Chiu Chen, Chia Yi Hsien (TW)

(73) Assignee: Tien Heng Machinery Co., Ltd., Chia Yi Hsien (TW)

( * ) Notice: Subject to any disclaimer, the term of this patent is extended or adjusted under 35 U.S.C. 154(b) by 0 days.

(21) Appl. No.: 11/599,315

(22) Filed: Nov. 15, 2006

(65) Prior Publication Data

US 2008/0113856 A1 May 15, 2008

(51) Int. Cl.
*B31B 1/80* (2006.01)

(52) U.S. Cl. ..... 493/313; 493/122; 53/564; 53/573

(58) Field of Classification Search ..... 493/122–127, 493/181, 183, 313, 317, 475; 53/458, 564, 53/565, 566, 573, 376.7, 376.8, 377.2, 377.3, 53/382.2, 382.3
See application file for complete search history.

(56) References Cited

U.S. PATENT DOCUMENTS 5,022,214 A * 6/1991 Kim ..... 53/242
5,106,359 A * 4/1992 Lott ..... 493/125
5,112,288 A * 5/1992 Ulrich et al. ..... 493/27
5,115,625 A * 5/1992 Barbulesco et al. ..... 53/467
5,290,224 A * 3/1994 Boix Jaen ..... 493/183
5,372,569 A * 12/1994 Ballos, III ..... 493/316
5,393,291 A * 2/1995 Wingerter ..... 493/116
5,454,776 A * 10/1995 Ulrich et al. ..... 493/117
5,957,825 A * 9/1999 Marchetti ..... 493/313
6,080,095 A * 6/2000 Chen ..... 493/309
6,669,616 B1 * 12/2003 Bierenacki et al. ..... 493/316
6,764,436 B1 * 7/2004 Mazurek ..... 493/120
6,926,652 B2 * 8/2005 Marchetti ..... 493/80

* cited by examiner

*Primary Examiner*—Hemant M. Desai
(74) *Attorney, Agent, or Firm*—Rosenberg, Klein & Lee

(57) ABSTRACT feeding mechanism, an expanding mechanism, a folding mechanism for folding front and rear parts of a bottom of a cardboard box, a folding mechanism for folding left and right parts of a bottom of a cardboard box, and a conveying mechanism; the feeding mechanism has a holding space, in which flattened boxes are received; the expanding mechanism includes a horizontally moving member, an expanding arm pivoted to the horizontally moving member, and several suction elements; a cardboard box will be expanded when the horizontally moving member moves with the suction elements applying suction on the box to fix the box thereto, and with the expanding arm pivoting 90 degrees; after a cardboard box has been expanded, the folding mechanisms function one after the other to fold front and rear parts and left and right parts of a bottom of the box.

15 Claims, 16 Drawing Sheets

APPARATUS FOR RAPIDLY EXPANDING AND FOLDING CARDBOARD BOXES

BACKGROUND OF THE INVENTION

1. Field of the Invention

The present invention relates to an apparatus for expanding and folding cardboard boxes, more particularly one, which includes a feeding mechanism, a box expanding mechanism, a folding mechanism for folding front and rear parts of a bottom of a cardboard box, a folding mechanism for folding left and right parts of a bottom of a cardboard box, and a conveying mechanism, and which can expand and fold a cardboard box rapidly in a few consecutive actions.

2. Brief Description of the Prior Art

Cardboard boxes are convenient to use because they are light in weight, inexpensive and recyclable, and come in a wide variety of sizes. Cardboard boxes are made of cardboards, which have been cut, formed with folds, which are between every two adjacent ones of four sides and between a bottom and the four sides as well as between a cover and the four sides, and connected at two vertical edges thereof so as to have a loop-shape. The cardboard boxes have a flattened shape in storage, and have to be expanded, and folded and sealed at the bottom so as to be ready for use.

Manufacturers usually use automatic apparatuses to expand, fold, and seal cardboard boxes in order to save labor and time. However, there's still room for improvement when it comes to the working speed of cardboard box expanding and folding apparatuses.

SUMMARY OF THE INVENTION

It is a main object of the present invention to provide an apparatus capable of rapidly expanding and folding cardboard boxes in a few consecutive actions.

The apparatus of the present invention includes:

a bed;

a feeding mechanism disposed on one side of the bed for holding cardboard boxes, each of which includes four wall portions, and a bottom including four parts;

a box expanding mechanism including a horizontal rail, a horizontally moving seat fitted on the horizontal rail in a linearly displaceable manner, a box expanding arm pivoted to the horizontally moving seat, and several suction elements fitted to the horizontally moving seat and the box expanding arm for applying suction force on cardboard boxes;

a first folding mechanism used for folding front and rear parts of a bottom of a cardboard box, and including front and rear folding arms for folding front and rear parts of a bottom of a cardboard box respectively;

a second folding mechanism used for folding left and right parts of a bottom of a box, and including an up and down moving member, two arm holders, two clamping arms, and two rotary members each connected to one of the clamping arms; the arm holders are each connected to an opening and closing device so as to be movable left and right on the up and down moving member; the clamping arms will be rotated in relation to the arm holders when the rotary members functions; left and right parts of a bottom of a box will be received in the clamping arms when the up and down moving member is moving up and down, and the opening and closing device is moving; the clamping arms will cause left and right parts of a bottom of a box to fold when the clamping arms are rotating; and a conveying mechanism including a pushing unit, and two conveying belts; the pushing unit is used for pushing an expanded and folded cardboard box to one side; the conveying belts will move an expanded and folded cardboard box to the rear after the pushing unit has functioned.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
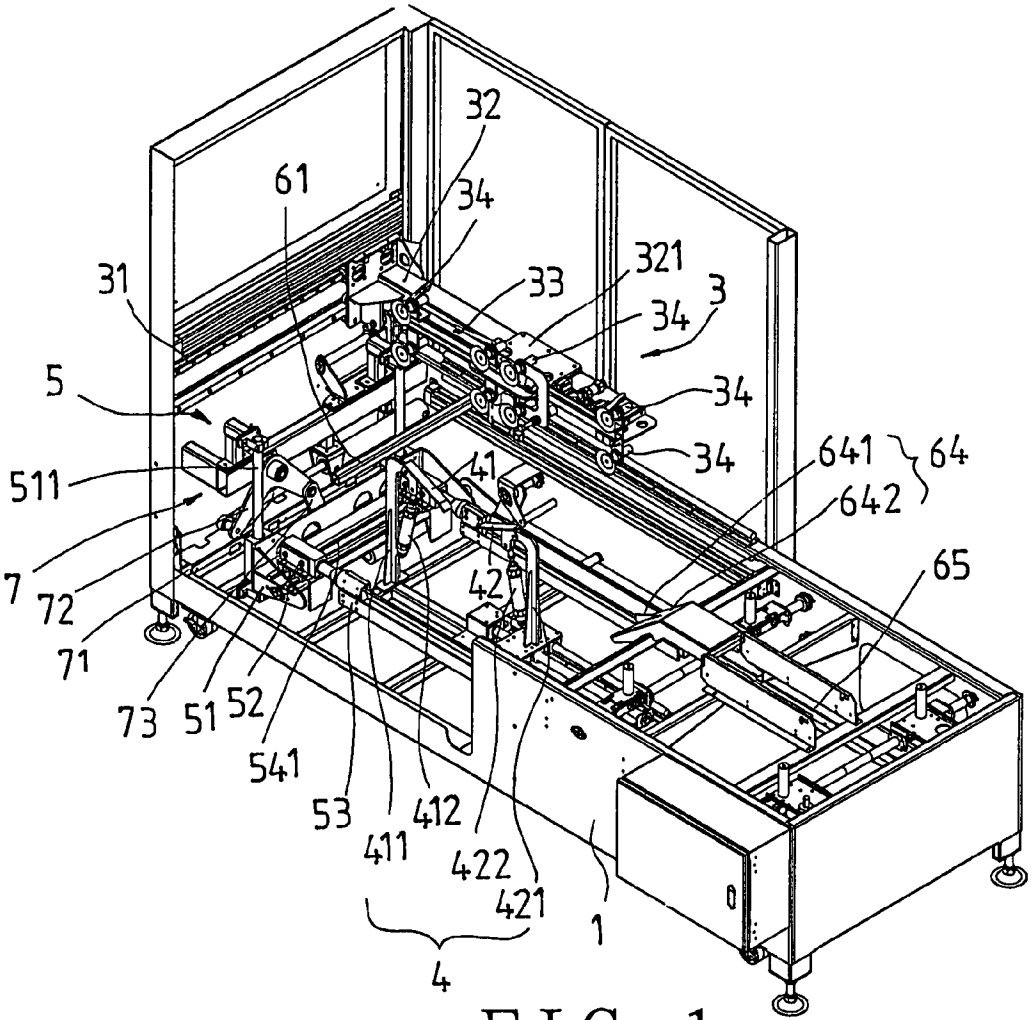
FIG. 1 is a perspective view of the present invention.
Figure 2:
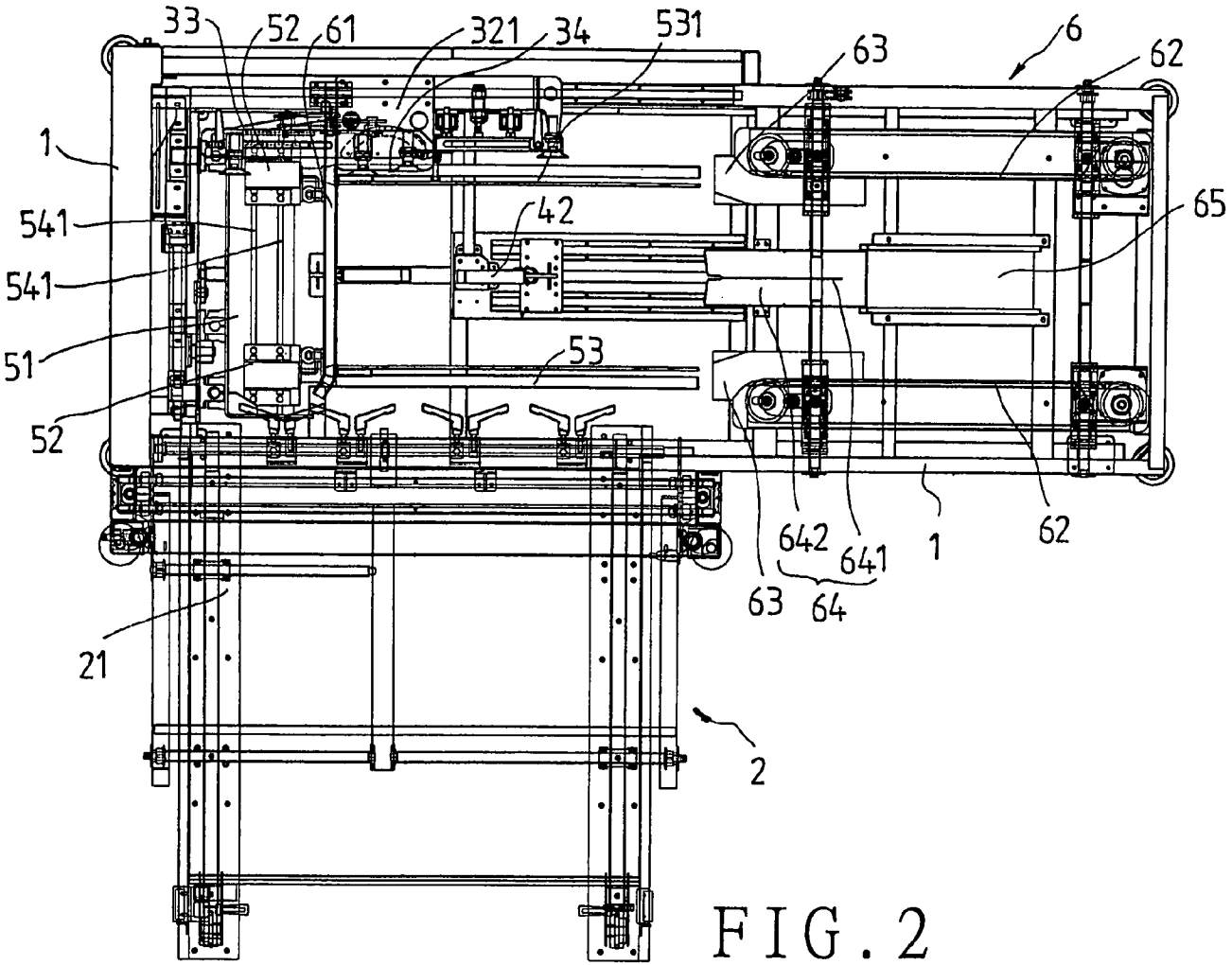
FIG. 2 is a top view of the present invention.
Figure 3:
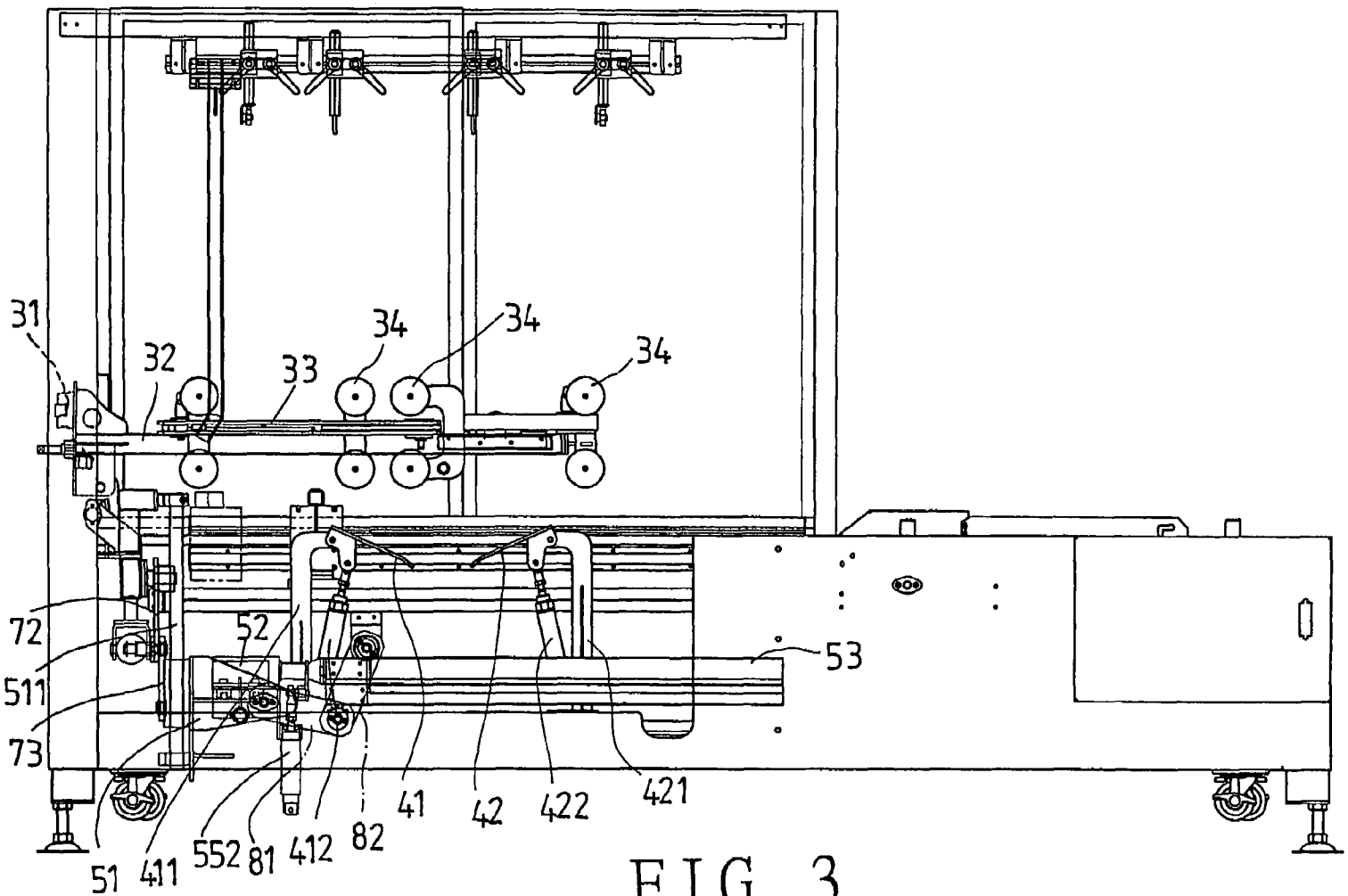
FIG. 3 is a front view of the present invention.
Figure 4:
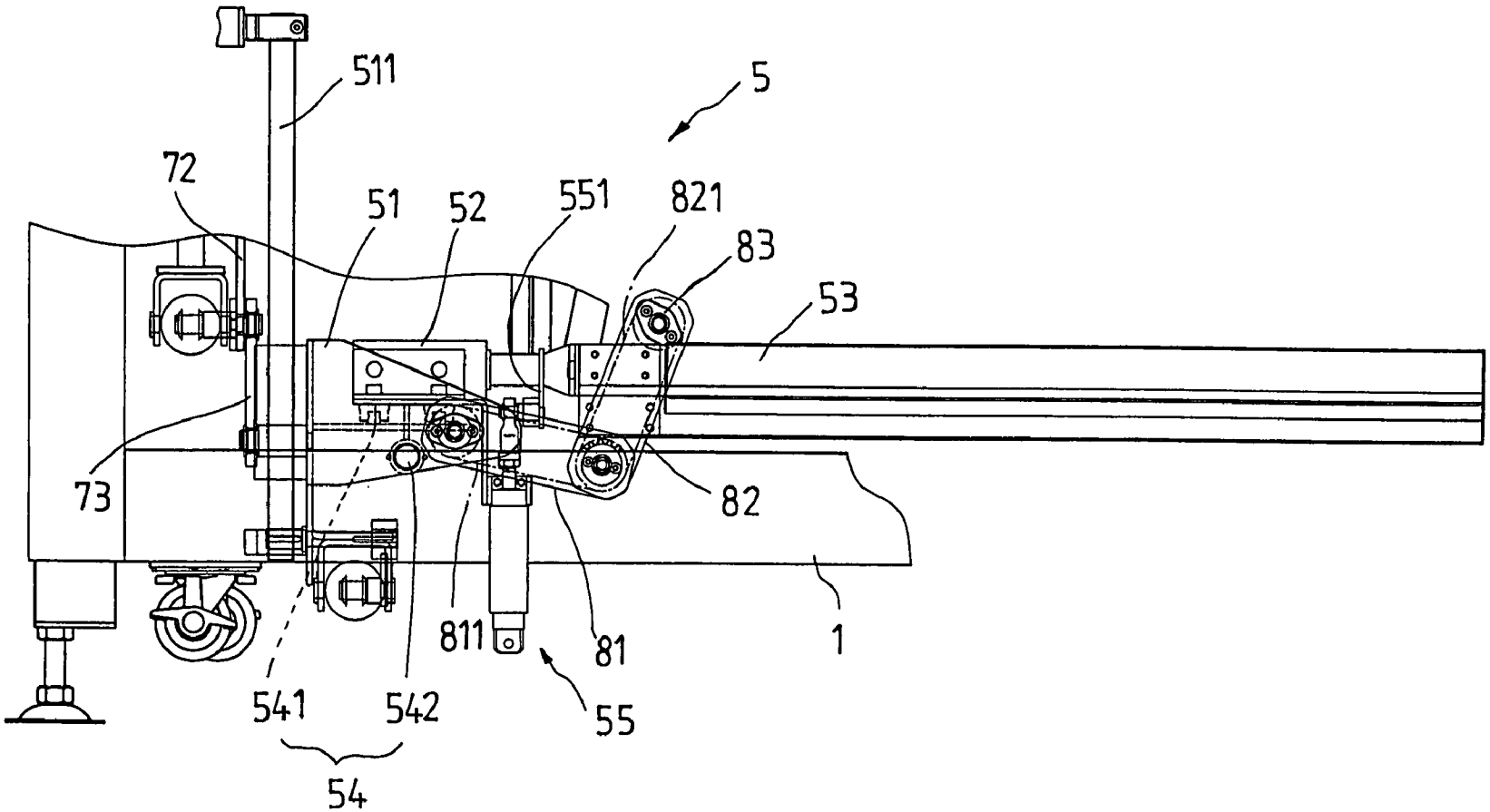
FIG. 4 is a partial front view of the present invention.
Figure 5:
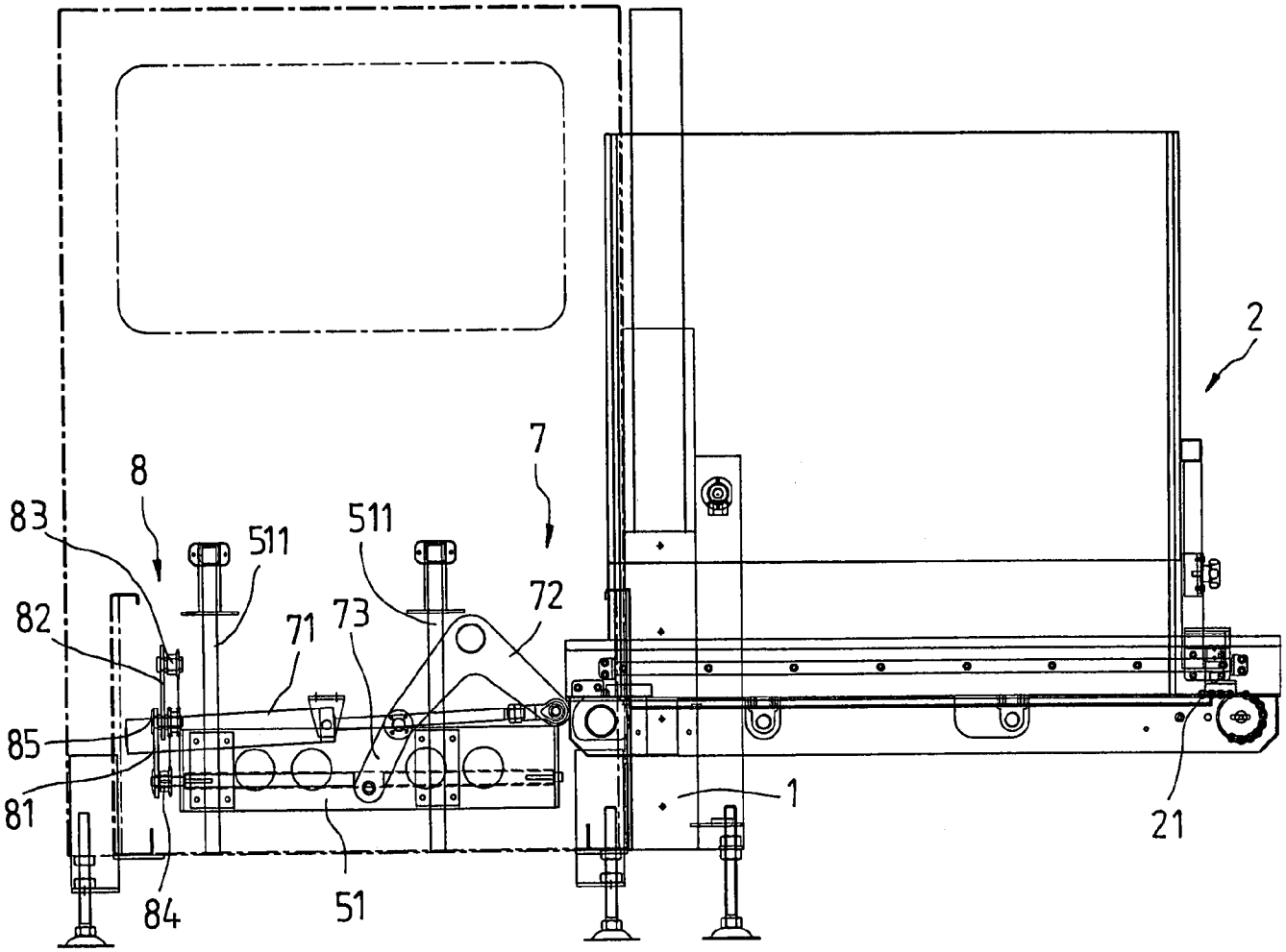
FIG. 5 is a side view of the present invention, taken before the up and down moving member is lifted.
Figure 6:
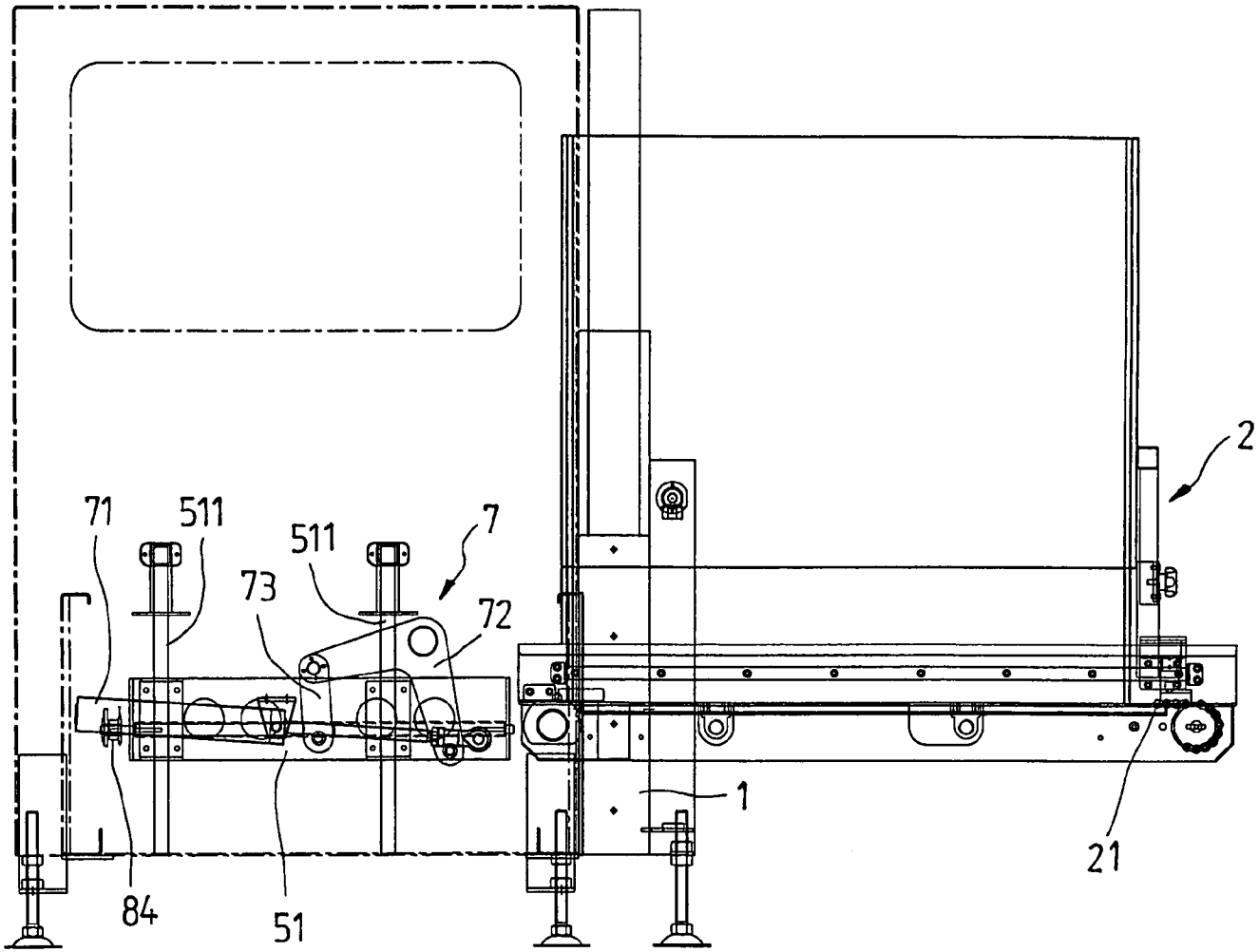
FIG. 6 is a side view of the present invention, taken after the up and down moving member is lifted.
Figure 7:
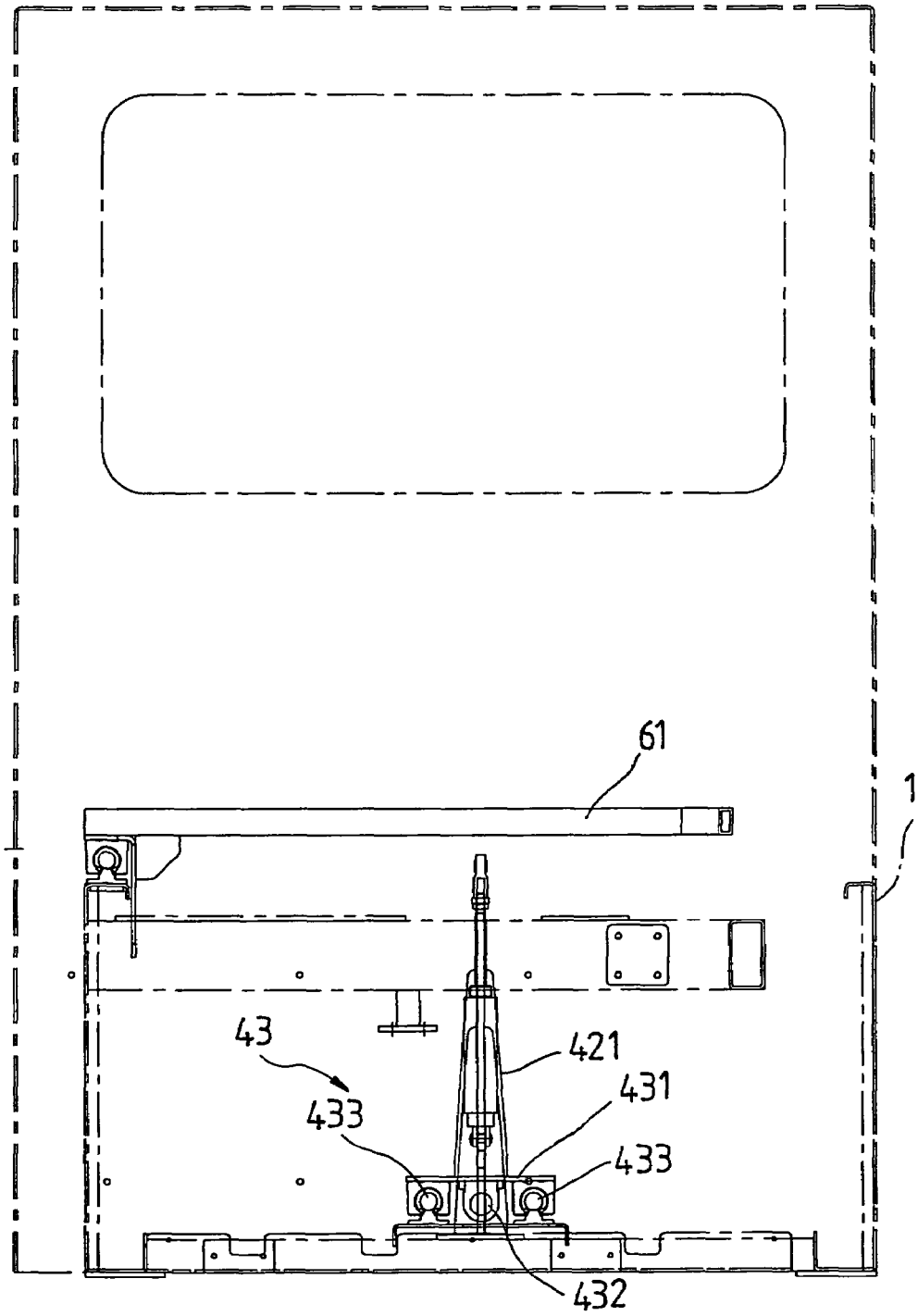
FIG. 7 is a side view of the present invention, which mainly shows position of the pushing member.

Referring to FIGS. 1 to 14, a preferred embodiment of an apparatus for rapidly expanding and folding cardboard boxes consists of a bed 1, a feeding mechanism 2, a box expanding mechanism 3, a folding mechanism 4 for folding front and rear parts of a bottom of a box, a folding mechanism 5 for folding left and right parts of a bottom of a box, and a conveying mechanism 6.

The feeding mechanism 2 is disposed on one side of the bed 1, and has a hollow portion 21 for holding cardboard boxes (A). Each of the cardboard boxes (A) includes four wall portions (A1), and a bottom including four parts (A21), (A22), (A23), and (A24) connected to respective ones of the four wall portions (A1). The cardboard boxes (A) are flattened with two wall portions (A1) thereof being pressed against the other two wall portions (A1), and positioned closely together in an upright position, one after another, inside the holding portion 21. The four parts (A21), (A22), (A23), and (A24) of the bottoms of the cardboard boxes (A) are supported on the holding portion 21 at lower ends thereof.

The box expanding mechanism 3 includes a horizontal rail 31, a horizontally moving seat 32, a box expanding arm 33, and several suction elements 34. The horizontal rail 31 is disposed on the bed 1 in a horizontal position, and the horizontally moving seat 32 is fitted on the horizontal rail 31 in a linearly displaceable manner. The box expanding arm 33 is pivoted to the horizontally moving seat 32. The horizontally moving seat 32 has an extension portion 321, which has a curved guide rail 322 with an angle of curvature of 180 degrees on one side. The box expanding arm 33 has two guide bars 331 fitted in the curved guide rail 322. A pushing member 35 is pivoted to the box expanding arm 33 at one end, and connected to the horizontally moving seat 32 at the other end. More particularly, the pivotal portion of the pushing member 35 is between the guide bars 331. Therefore, when the pushing member 35 is lengthening and shortening, the box expanding arm 33 will move along the curved guide rail 322, and rotate relative to the extension portion 321 of the horizontally moving seat 32. The pushing member 35 can be an air pressure cylinder, an oil hydraulic cylinder or other kinds of devices capable of lengthening and shortening.

The suction elements 34 are fitted to the horizontally moving seat 32 and the box expanding arm 33 for applying suction force on the cardboard boxes (A). Each of the suction elements 34 includes a suction cap 341, and a pipe 342 for removing air through. At least one pair of suction elements 34 are securely fitted to the box expanding arm 33 and the extension portion 321 of the horizontally moving seat 32 respectively. At least one pair of suction elements 34 are respectively fitted to the box expanding arm 33 and the extension portion 321 in a movable way so as to be adjustable in position. More detailedly, the box expanding arm 33 and the extension portion 321 have holes 323, and 332 thereon, and the adjustable ones of the suction elements 34 are fitted to the holes 323 and 332; thus, the distance between the fixed suction elements 34 and the adjustable suction elements 34 can be adjusted to be suitable for cardboard boxes (A) of different dimensions/widths.

Figure 8:
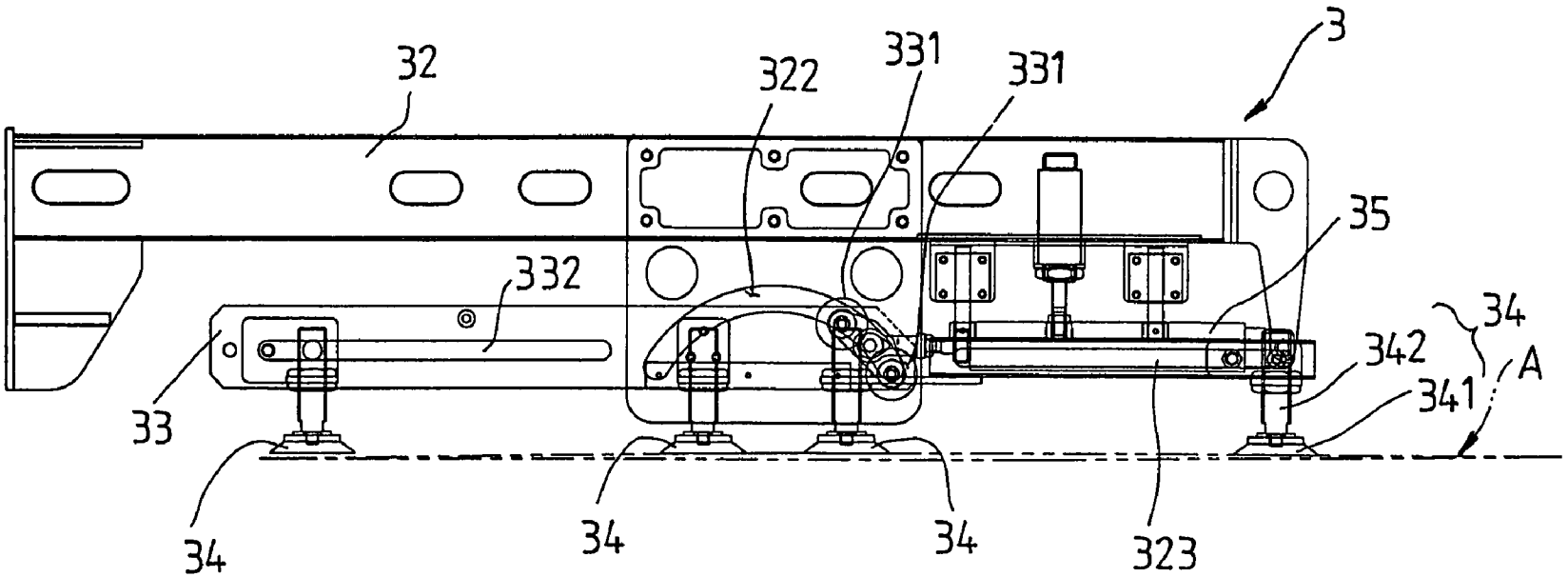
FIG. 8 is a top view of the present invention, taken before a box is expanded.
Figure 9:
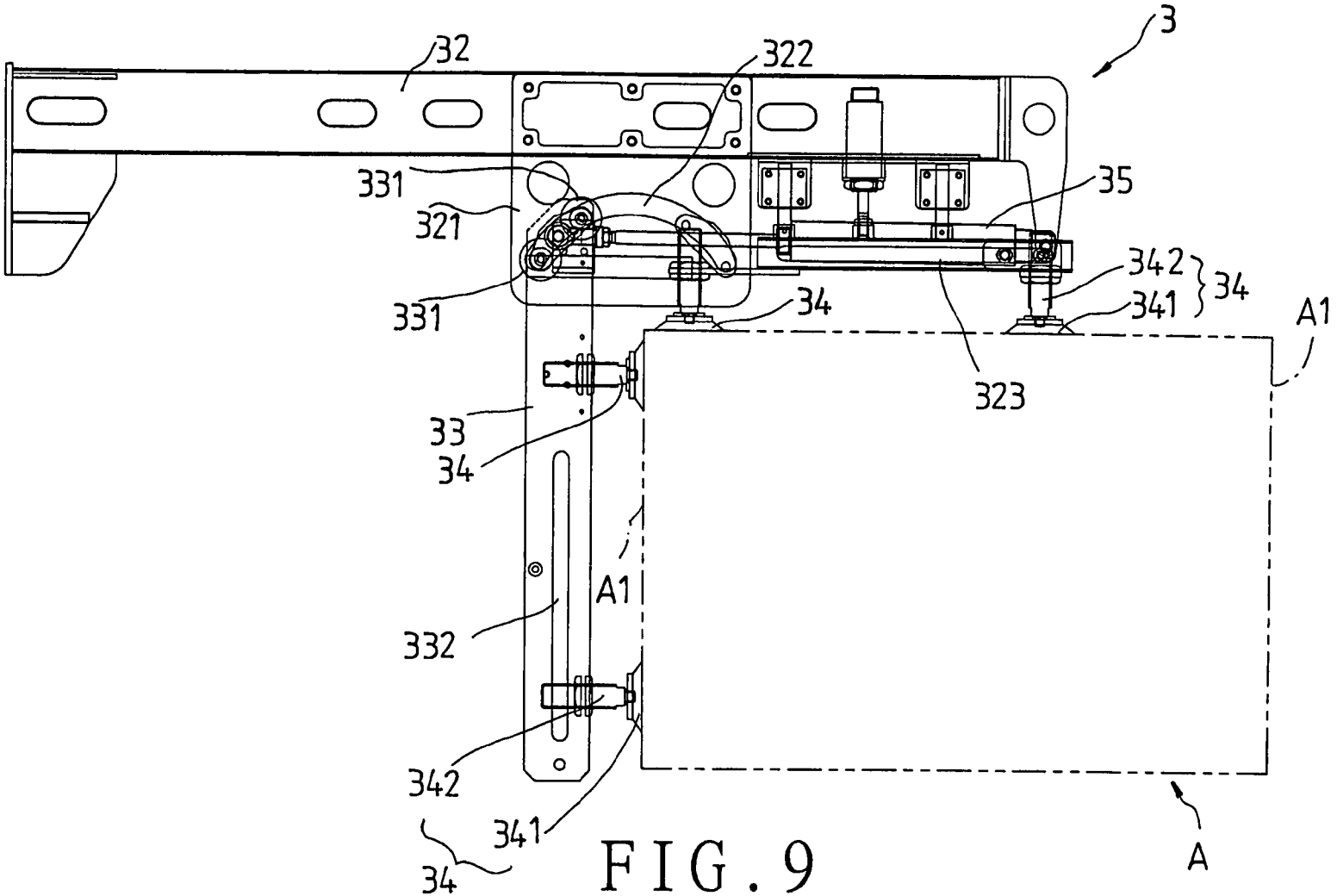
FIG. 9 is a top view of the present invention, taken after a box is expanded.

The suction elements 34 will apply suction force on a cardboard box (A) so as to make the cardboard box (A) fixed thereto as soon as the horizontally moving seat 32 moves close to the cardboard box (A) along the horizontal rail 31. Referring to FIGS. 8 and 9, when the present preferred embodiment is used, the two pairs of suction elements 34 on the extension portions 321 will apply suction force on a first one of the wall portions (A1) of a box (A), and the two pairs of suction elements 34 on the box expanding arm 33 will apply suction force on one of the wall portions (A1) of the box (A) that is adjacent to the first wall portion (A1), and next the horizontally moving seat 32 will move backwards, and the pushing member 35 will push the box expanding arm 33 and make the box expanding arm 33 rotate such that the box (A) is gradually moved to a fully expanded shape with four right-angled corners.

The first folding mechanism 4 is used for folding front and rear parts of bottoms of boxes, and includes front and rear folding arms 41, and 42, front and rear upright post parts 411, 421, and telescopic moving elements 412, and 422; the front and the rear folding arms 41, and 42 are pivoted to the front and the rear upright post parts 411, and 421 respectively; the telescopic moving element 412 is pivoted to the front folding arm 41 at one end, and the front upright post part 411 at the other end; the telescopic moving element 422 is pivoted to the rear folding arm 42 at one end, and the rear upright post part 421 at the other end. Thus, the front and the rear folding arms 41, and 42 will pivot relative to the front and the rear upright post parts 411, and 421 respectively when the telescopic moving elements 412 and 422 are lengthening and shortening.

Figure 10:
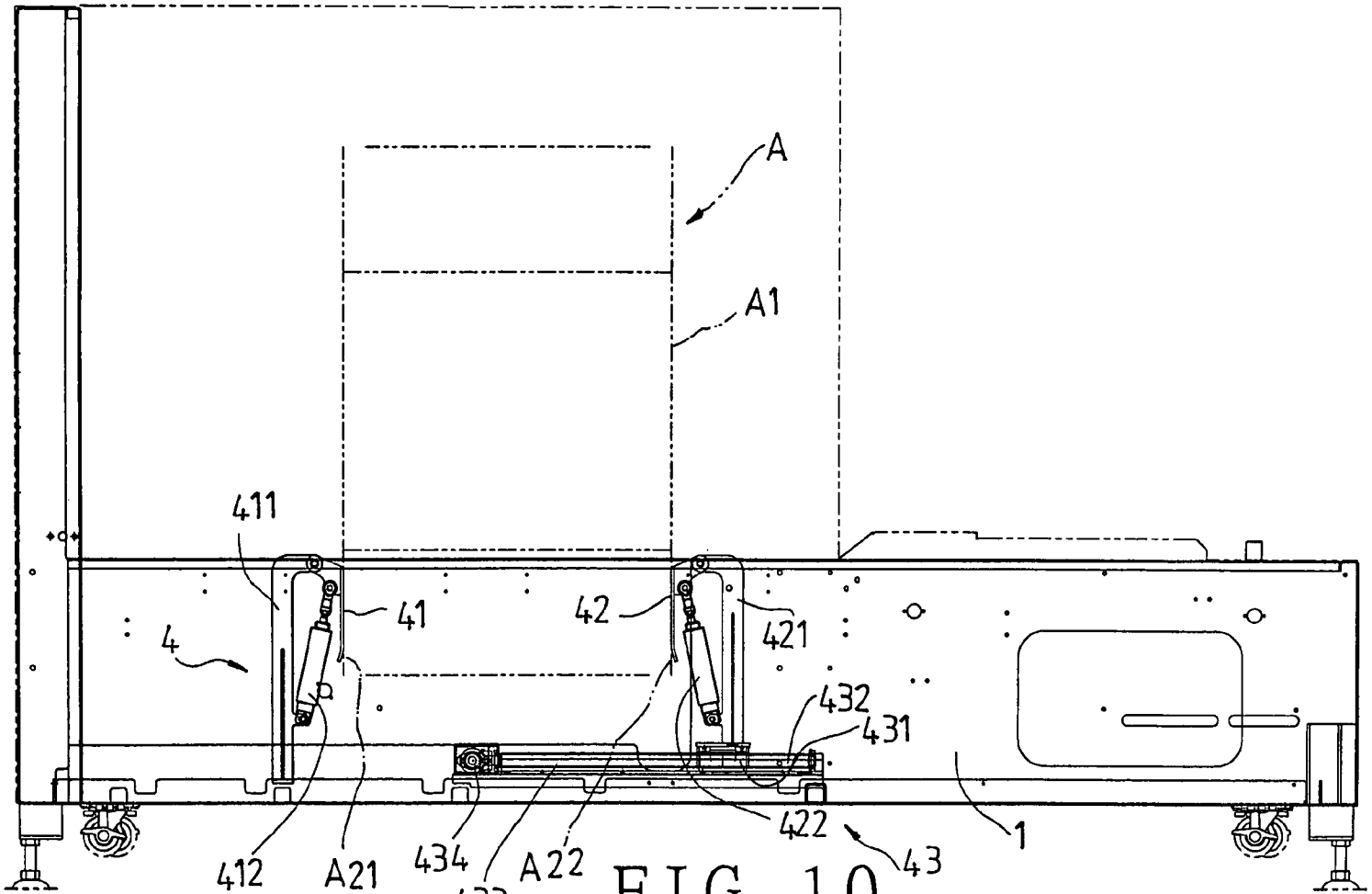
FIG. 10 is a front view of the present invention, taken before the front and the rear parts of the bottom of a box are folded.
Figure 11:
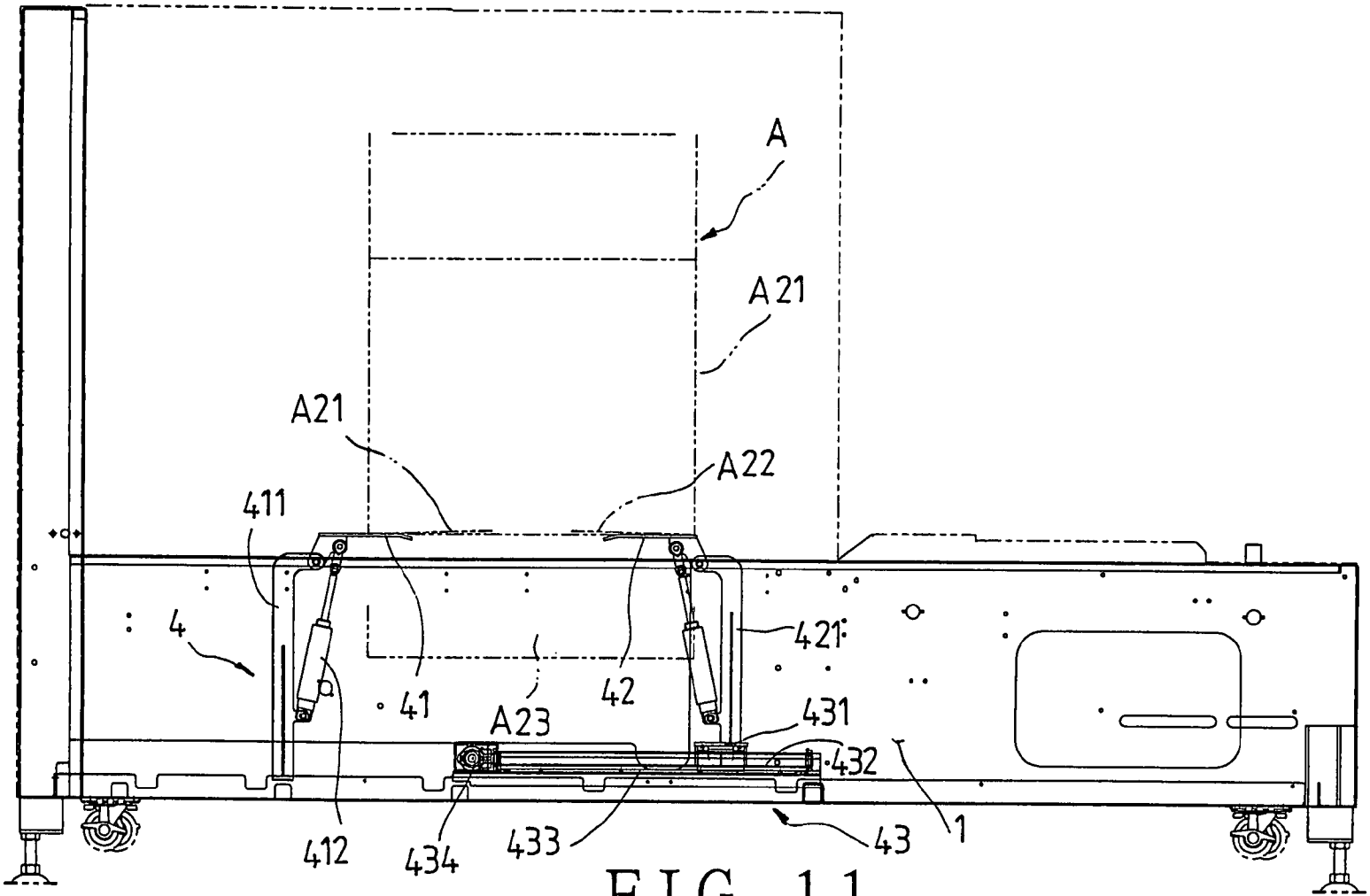
FIG. 11 is a front view of the present invention, taken after the front and the rear parts of the bottom of a box are folded.

Referring to FIGS. 10 and 11, after a cardboard box (A) has been expanded, the front and the rear folding arms 41, and 42 will pivot and push the front and the rear parts (A21) and (A22) of the bottom of the cardboard box (A) such that the front and the rear parts (A21) and (A22) of the bottom bend 90 degrees inwards.

The front upright post part 411 is secured on the bed 1, and the rear upright post part 421 is linearly displaceable relative to the front upright post part 411 for adjusting distance between the front and the rear upright post parts 411 and 421. More detailedly, the rear upright post part 421 is securely joined to an adjustment assembly 43, which includes a sliding member 431, an adjusting rod 432, two guide rods 433, and a rotating rod 434; the rear upright post part 421 is secured to the sliding member 431 at a lower end; the adjusting rod 432 is passed through and threadedly engaged with the sliding member 431; the guide rods 433 are positioned on two sides of the adjusting rod 432 and passed through the sliding member 431; the rotating rod 434 is connected to one end of the adjusting rod 432 so that the adjusting rod 432 will be rotated when the rotating rod 434 is rotated. Therefore, the rear upright post part 421 will be linearly displaced relative to the guide rods 433 and the adjusting rod 432 together with the sliding member 431 when the rotating rod 434 is rotated.

The second folding mechanism 5 is used for folding left and right parts of bottoms of boxes, and includes an up and down moving member 51, two arm holders 52, and two clamping arms 53. The arm holders 52 are fitted to the up and down moving member 51 in such a way as to be movable leftwards and rightwards. The clamping arms 53 are fitted to respective ones of the arm holders 52 in a rotary manner, and each have a receiving space 531 thereon for receiving a respective one of left and right parts (A23) and (A24) of bottoms of boxes (A). An up and down moving assembly 7 is interposed between the bed 1 and the up and down moving member 51 for making the up and down moving member 51 move up and down relative to the bed 1. And, two guide rods 511 are passed through the up and down moving member 51 for allowing the up and down moving member 51 to move smoothly. The up and down moving assembly 7 includes a telescopic driving member 71, a bent arm 72, and a short connecting rod 73. The bent arm 72 is in the shape of a "V", and pivoted to the bed 1 at a middle portion thereof. The telescopic driving member 71 is connected to the bed 1 at one end, and pivoted to a first end of the bent arm 72 at the other end thereof. The short connecting rod 73 is pivoted to the other end of the bent arm 72 at one end thereof, and pivoted to the up and down moving member 51 at the other end. Therefore, when the telescopic driving member 71 is lengthening and shortening, motion will be passed on to the up and down moving member 51 through the bent arm 72 and the short connecting rod 73 so as to move the up and down moving member 51 up and down. When the up and down moving member 51 moves up, left and right parts (A23) and (A24) of bottoms of boxes (A) will be received in the receiving spaces 531 of the clamping arms 53. The telescopic driving member 71 can be an air pressure cylinder, an oil hydraulic cylinder or other kinds of devices capable of lengthening and shortening.

The arm holders 52 are each connected to an opening and closing device 54, which includes a rail 541, a threaded rod 542, and a transmission module 8 connected to one end of the threaded rod 542. Both of the threaded rods 542 are passed through respective ones of the arm holders 52 with their threads being in opposite directions. The arm holders 52 are fitted to respective ones of the rails 541 in a linearly displaceable manner so as to be capable of sliding on the up and down moving member 51. When motion is passed on to the threaded rods 542 through the transmission modules 8, the threaded rods 542 will turn so as to make the arm holders 52 move synchronously in either the same direction or opposite directions; thus, distance between both the arm holders 52 is adjusted to be suitable for boxes with a certain width.

Each of the threaded rods 542 has a rolling wheel 84 secured on a first end thereof. And, each of the transmission modules 8 includes:

a first connecting rod 81; the first connecting rod 81 is pivoted at one end to the first end of one of the threaded rods 542, on which the rolling wheel 84 is secured;

a second connecting rod 82; the first connecting rod 81 is pivoted at the other end thereof to one end of the second connecting rod 82;

a first transmission belt 811;

a second transmission belt 821;

a transmission axle 83; the transmission axle 83 is pivoted to the bed 1 in a rotary manner; the second connecting rod 82 is pivoted at the other end thereof to the transmission axle 83; and a connecting axle 85 with two turning wheels 851 and 852 thereon; the connecting axle 85 is disposed at the pivotal joint between the first and the second connecting rods 81 and 82; the first transmission belt 811 is passed over the rolling wheel 84 of the threaded rod 542, and passed over the turning wheel 581 of the connecting axle 85; the second transmission belt 821 is passed over the turning wheel 852 of the connecting axle 85, and passed over the transmission axle 83.

Therefore, when the transmission axles 83 are rotated, motion will be passed on to cause rotation of the threaded rods 542 through the first transmission belts 811, the connecting axles 85, the second transmission belts 821, and the rolling wheels 84, and in turn the arm holders 52 are moved relative to each other to adjust the distance between them. Furthermore, when the up and down moving member 51 is moved up and down, the first and the second connecting rods 81 and 82 will be moved together with the up and down moving member 51; therefore, adjustment of distance between the arm holders 52 still can be carried out.

The clamping arms 53 of the second folding mechanism 5 are each connected to a rotary member 55, which is used for causing rotational motion of the clamping arm 53 in relation to the arm holders 52. Each rotary member 55 includes an eccentric rod 551, and a telescopic control element 552; the eccentric rod 551 is fixedly joined to the clamping arm 53 at one end, and pivoted at the other end thereof to one end of the telescopic control element 552; the telescopic control element 552 is connected to the bed 1 at the other end; when the telescopic control elements 552 are lengthening and shortening, the motion will be passed on through the eccentric rods 551 so as to make the clamping arms 53 rotate. The telescopic control elements 552 can be an air pressure cylinder, an oil hydraulic cylinder or other kinds of devices capable of lengthening and shortening.

Figure 12:
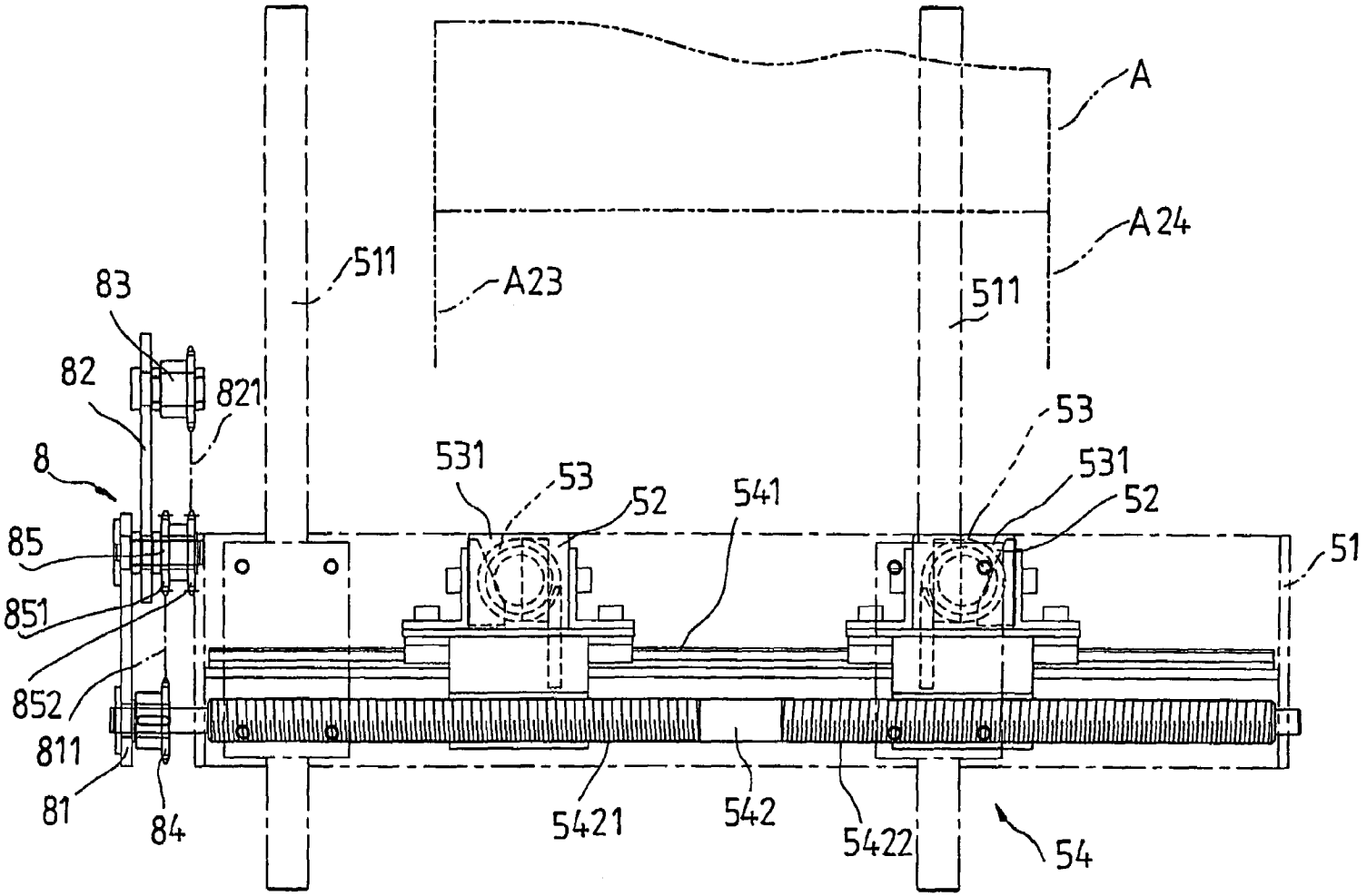
FIG. 12 is a front view of the present invention, taken before the left and the right parts of the bottom of a box are folded.
Figure 13:
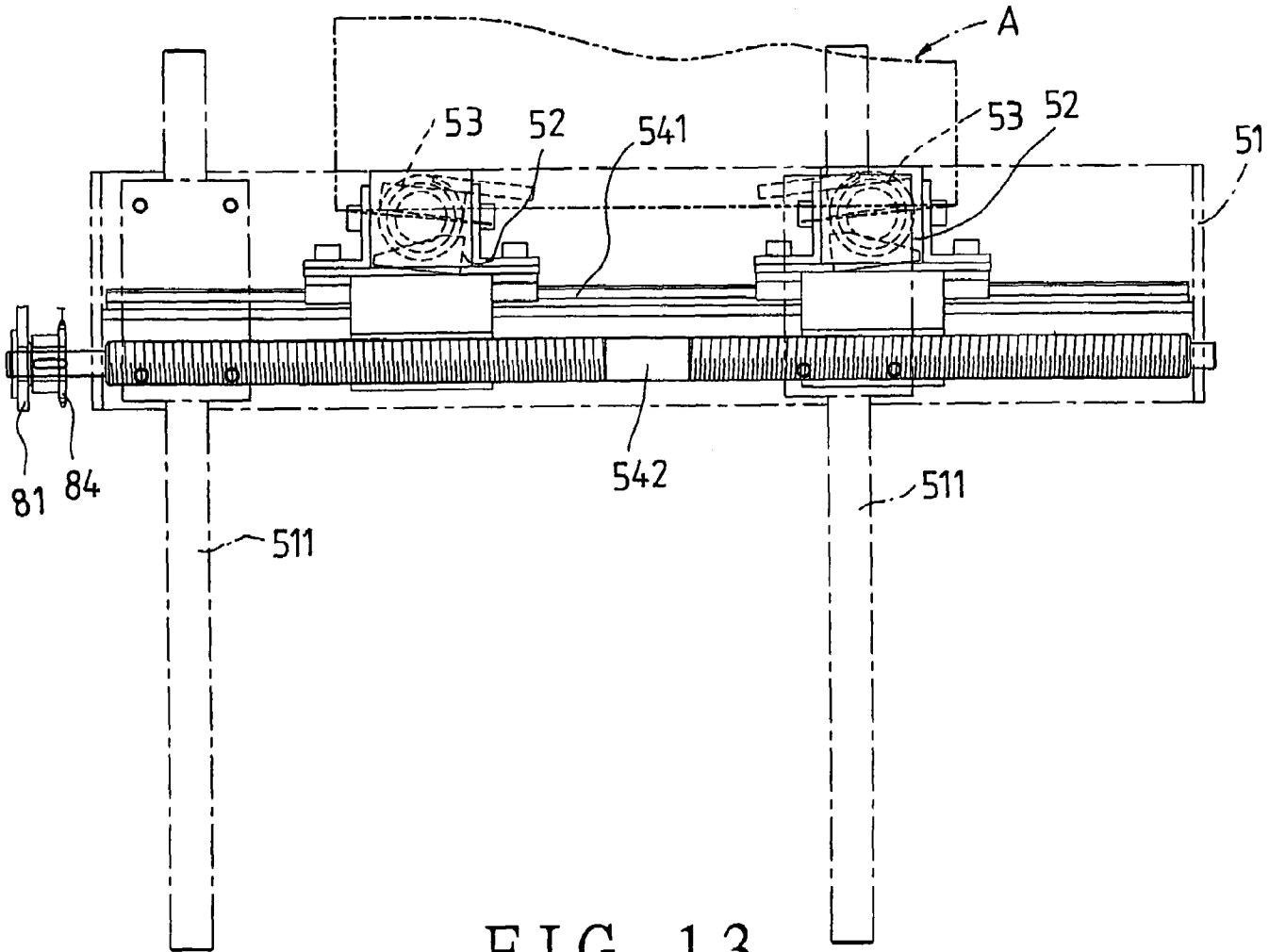
FIG. 13 is a front view of the present invention, taken after the left and the right parts of the bottom of a box are folded.
Figure 14:
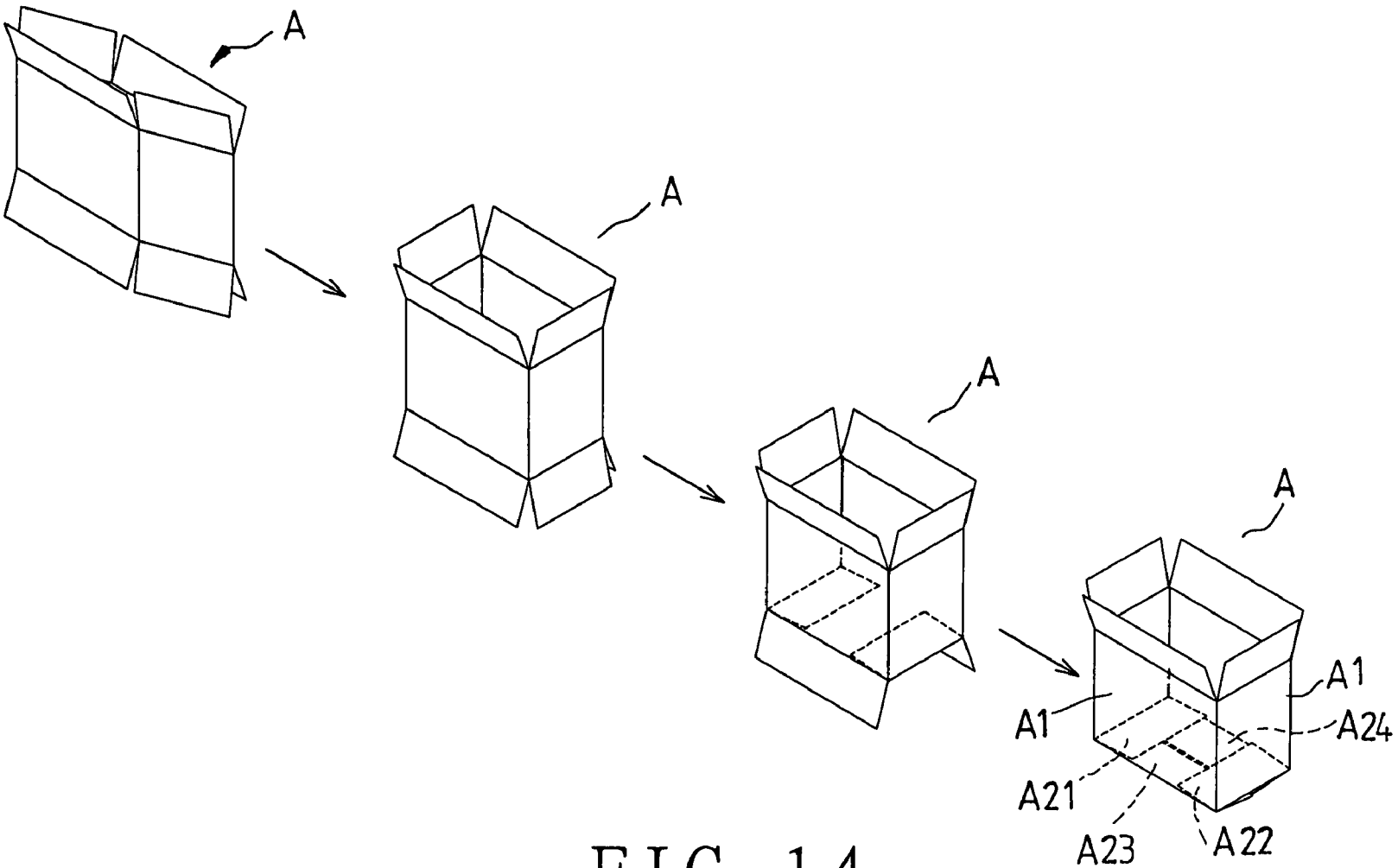
FIG. 14 shows the box erecting and folding process.

Referring to FIGS. 12 and 13, after the front and the rear parts (A21) and (A22) of a bottom of a cardboard box have been folded, and the opening and closing devices 54 moved so as to make the clamping arms 53 face the left and the right parts (A23) and (A24) of the bottom of the box, the up and down moving member 51 will be moved upwards for the left and the right parts (A23) and (A24) to be received in the receiving spaces 531 of the clamping arms 53. Next, the clamping arms 53 will be rotated 90 degrees so as to fold the left and the right parts (A23) and (A24) of the bottom of the box inwards.

A cardboard box (A) will be moved outside the box expanding and folding apparatus by means of the conveying mechanism 6 after the front and the rear parts (A21) and (A22) of the bottom of the cardboard box (A) have been folded, and the left and the right parts (A23) and (A24) of the bottom of the cardboard box (A) folded so as to be pressed against lower sides of the front and the rear parts (A21) and (A22). The conveying mechanism 6 includes a pushing unit 61, and two conveying belts 62. The pushing unit 61 is provided for pushing an expanded and folded cardboard box (A) away from the clamping arms 53, and has a rod shape, and it is fitted at one end thereof to the bed 1 in a movable manner. The conveying belts 62 will hold the cardboard box (A) between them and move the box (A) to the rear after the pushing unit 61 has pushed the cardboard box (A) away from the clamping arms 53.

In order to prevent folded bottoms of a box from moving and changing position, the conveying mechanism 6 further has two bearing portions 63, and a propping element 64. The bearing portions 63 are on two opposing sides of the bed 1 for propping folded left and right parts (A23) and (A24) of a bottom of a box (A). The propping element 64 is used for propping folded front and rear parts (A21) and (A22) of a bottom of a box (A), and includes an upright plate part 641, and a bottom plate part 642 perpendicular to the upright plate part 641; in use, the upright plate part 641 will pass through an aperture between the folded left and right parts (A23) and (A24) to prop the folded front and rear parts (A21) and (A22) of the bottom.

The present cardboard box expanding and folding apparatus is further equipped with a tape applying device (not shown) at the position marked with numeral "65". The tape applying device will apply a tape on two opposing edges of the folded left and right parts (A23) and (A24) of the bottom of the box when the box is being moved through it, thus sealing the aperture between the folded left and right parts (A23) and (A24). The tape applying device is disposed on one side of one of the conveying belts 62, and is preferably disposed between the conveying belts 62.

Figure 15:
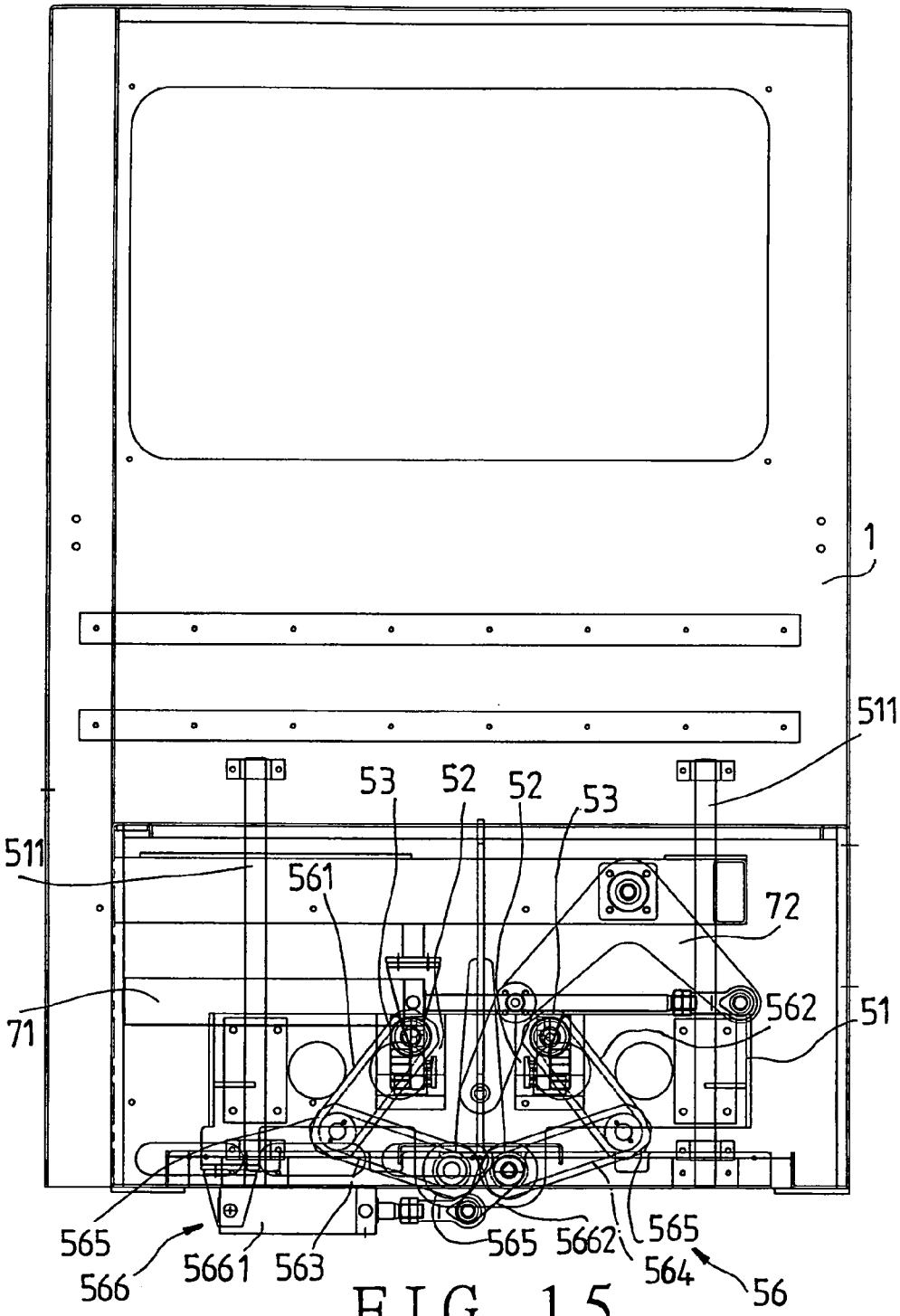
FIG. 15 is a view of the second preferred embodiment of the rotary member, with the arm holders being near each other.
Figure 16:
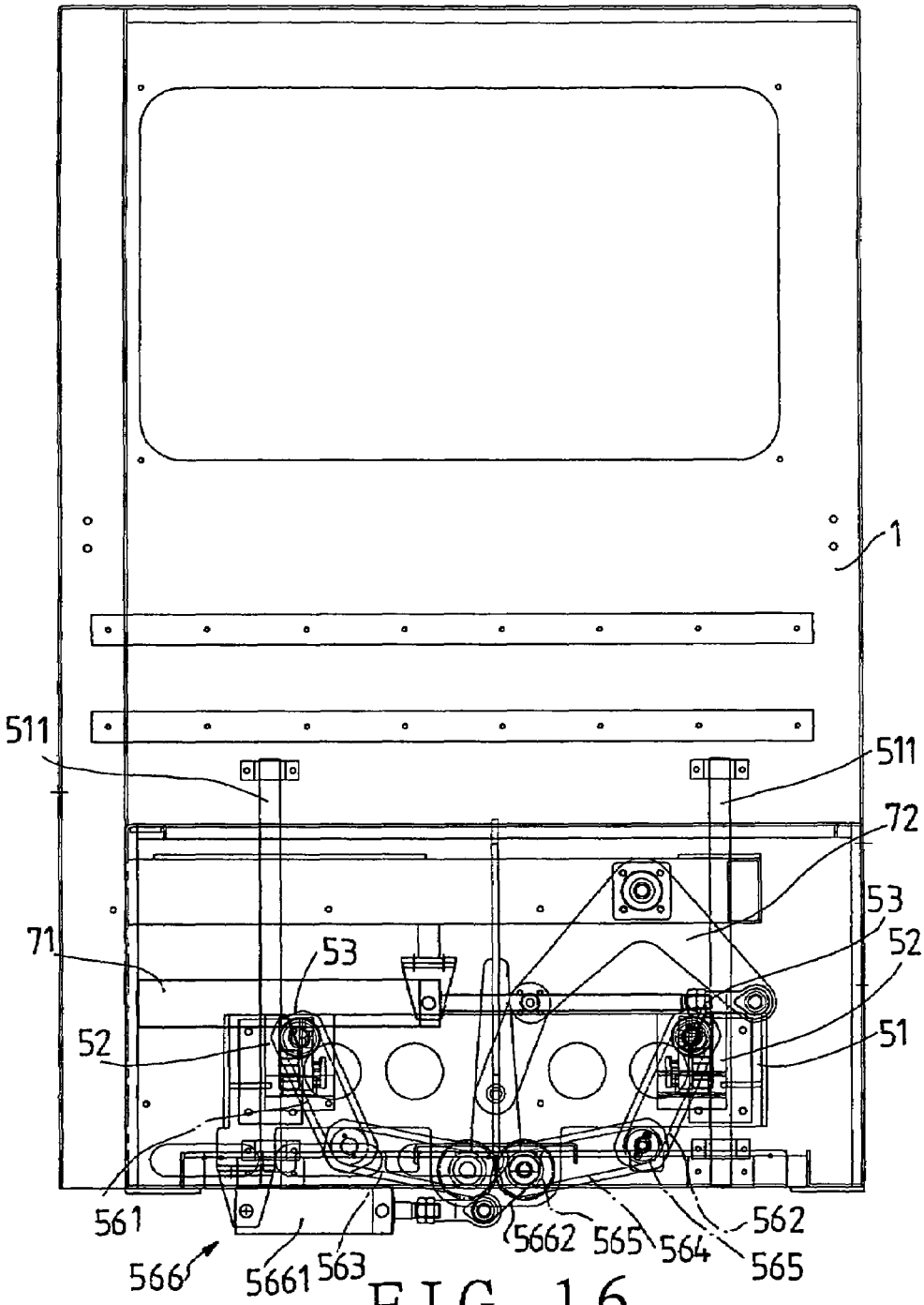
FIG. 16 is a view of the second preferred embodiment of the rotary member, with the arm holders being apart from each other.

Referring to FIGS. 15 and 16, a second preferred embodiment of a cardboard box expanding and folding apparatus is provided, which includes two rotary members 56 different from the rotary members 55 of the first preferred embodiment. Each of the rotary members 56 includes a left connecting rod assembly 561, a right connecting rod assembly 562, a left transmission assembly 563, a right transmission assembly 564, several transmission wheels 565, and a rotary driving element 566. The left and the right connecting rod assemblies 561 and 562 are pivoted at first ends thereof to the arm holders 52 to move left and right, and up and down together with the arm holders 52, and they are pivoted at the other ends to the bed 1. The transmission wheels 565 are fitted to the left and the right connecting rod assemblies 561 and 562, and the left and the right transmission assemblies 563 and 564 are connected to the transmission wheels 565 so as to be supported on the left and the right connecting rod assemblies 561 and 562 respectively. The left and the right transmission assemblies 563 and 564 are connected at first ends thereof to the clamping arms 53, 53 respectively, and they are connected together at the other (second) ends thereof. The left and the right transmission assemblies 563 and 564 are connected to the rotary driving element 566 at the second ends thereof such that the left and the right transmission assemblies 563 and 564 can be driven to rotate synchronously in opposite directions so as to cause rotational motion of the clamping arms 53 by means of the rotary driving element 566, thus causing the clamping arms 53 to rotate. Therefore, either when both the arm holders 52 are moving left and right or when both the arm holders 52 are moving up and down together with the up and down moving member 51, the first ends of the left and the right connecting rod assemblies 561 and 562 will move together with the arm holders 52, and in turn it is ensured that motion of the rotary driving element 566 be passed on to the clamping arms 53 for the clamping arms 53 to rotate to fold the left and the right parts (A23) and (A24) of the bottom of a cardboard box (A).

The purpose of the rotary driving elements 566 is to make both the clamping arms 53 rotate clockwise and counterclockwise respectively with the left and the right transmission assemblies 563 and 564 passing on the motion. In the present preferred embodiment, each of the rotary driving elements 566 includes a telescopic driving unit 5661, and a little connecting rod 5662; the telescopic driving unit 5661 is pivoted to a first end of the little connecting rod 5662 at one end thereof; the little connecting rod 5662 is connected at the other end thereof to one of the left and the right transmission assemblies 563 and 564. When the telescopic driving unit 5661 is lengthening and shortening, it will make the little connecting rod 5662 swing, and drive the left and the right transmission assemblies 563 and 564 so as to rotate the corresponding clamping arm 53.

From the above description, it can be seen that with the help of the cardboard box expanding and folding apparatus of the present invention, cardboard boxes can be rapidly expanded and folded in a few consecutive actions. And, after cardboard boxes have been expanded and folded, they further can be sealed at the bottoms so as not to change shape. Consequently, the cardboard box expanding and folding apparatus will save manufacturers much time.

What is claimed is:

1. An apparatus for rapidly expanding and folding cardboard boxes, comprising (a) a bed, (b) a feeding mechanism, the feeding mechanism being disposed on one side of the bed, the feeding mechanism holding cardboard boxes, each of which includes four wall portions, and a bottom including four parts;

(c) a box expanding mechanism, the box expanding mechanism including:

a horizontal rail, a horizontally moving seat fitted on the horizontal rail in a linearly displaceable manner, a box expanding arm, the box expanding arm being pivoted to the horizontally moving seat, and a plurality of suction elements, the suction elements being fitted to the horizontally moving seat and the box expanding arm, the plurality of suction elements applying suction force on the cardboard boxes;

(d) a first folding mechanism folding the front and rear parts of the bottom of the cardboard box, the first folding mechanism including the front and rear folding arms, the first folding mechanism folding the front and rear parts of the bottom of the cardboard box respectively, the pair of suction elements contact on the side of the cardboard box in the vertical direction, the pair of suction elements contact on the top of the cardboard box in the horizontal direction, the horizontally moving seat and the box expanding arm both have suction elements and the horizontally moving seat is pivoted with the box expanding arm, after the suction elements of the horizontally moving seat and the box expanding arm suck the cardboard box body, the box expanding arm rotates at a predetermined angle to expand one side of the cardboard box body;

(e) a second folding mechanism folding left and right parts of the bottom of the box, the second folding mechanism including:

an up and down moving member, an up and down moving assembly being interposed between the bed and the up and down moving member for making the up and down moving member move up and down relative to the bed;

two arm holders, the arm holders being each connected to an opening and closing device so as to be movable left and right on the up and down moving member; and two clamping arms, the clamping arms being each connected to a rotary member, the rotary member is used for causing rotational motion of the clamping arm in relation to the arm holders; the left and right parts of the bottom of the box being moved to be received in the clamping arms when the up and down moving member is moving up and down, and the opening and closing device is moving; the clamping arms being positioned to cause left and right parts of the bottom of the box to fold when the clamping arms are rotating after the left and the right parts have been received in the clamping arms; and (f) a conveying mechanism, the conveying mechanism including:

a pushing unit pushing an expanded and folded cardboard box to one side, and a plurality of conveying belts moving an expanded and folded cardboard box to a rear after the pushing unit has pushed the cardboard box.

2. The cardboard box expanding and folding apparatus as recited in claim 1, wherein the up and down moving member has an extension portion, which has a curved guide rail, and the box expanding arm has two guide bars on one side thereof, which are fitted in the curved guide rail, and a pushing member is pivoted at one end thereof to the box expanding arm, and connected at other end to the horizontally moving seat; when the pushing member is lengthening and shortening, the box expanding arm being moved along the curved guide rail, and rotate relative to the extension portion of the horizontally moving seat.

3. The cardboard box expanding and folding apparatus as recited in claim 1, wherein each of the suction elements includes a suction cap, and a pipe for removing air through, and at least one pair of said suction elements are securely fitted to the box expanding arm and the extension portion of the horizontally moving seat respectively, and at least one pair of said suction elements are respectively fitted to the box expanding arm and the extension portion in a movable manner so as to be adjustable in position.

4. The cardboard box expanding and folding apparatus as recited in claim 1, wherein the first folding mechanism further includes front and rear upright post parts, and first and second telescopic moving elements; the front and the rear folding arms being pivoted to the front and the rear upright post parts respectively; the first telescopic moving element being pivoted to the front folding arm at one end, and the front upright post part at other end; the second telescopic moving element being pivoted to the rear folding arm at one end, and the rear upright post part at other end; the front and the rear folding arms being positioned to pivot relative to the front and the rear upright post parts respectively when the telescopic moving elements are lengthening and shortening.

5. The cardboard box expanding and folding apparatus as recited in claim 4, wherein the rear upright post part is securely joined to an adjustment assembly, which includes a sliding member, an adjusting rod, two guide rods, and a rotating rod; the rear upright post part being secured to the sliding member at a lower end; the adjusting rod being passed through and threadedly engaged with the sliding member; the guide rods being positioned on two sides of the adjusting rod and passed through the sliding member; the rotating rod being connected to one end of the adjusting rod so that the rear upright post part will be linearly displaced to adjust position when the rotating rod is rotated.

6. The cardboard box expanding and folding apparatus as recited in claim 1, wherein the up and down moving assembly includes a telescopic driving member, a bent arm, and a short connecting rod; the telescopic driving member being connected at one end thereof to the bed, and pivoted at other end thereof to a first end of the bent arm; the bent arm being pivoted to the bed at a middle portion thereof; the short connecting rod being pivoted at one end thereof to other end of the bent arm, and pivoted at other end thereof to the up and down moving member; thus, the up and down moving member will be moved up and down when the telescopic driving member is lengthening and shortening.

7. The cardboard box expanding and folding apparatus as recited in claim 1, wherein each of the opening and closing devices includes at least one rail, a threaded rod, and a transmission module; the arm holders being fitted to respective ones of the rails in a linearly displaceable manner so as to be slideable on the up and down moving member; both of the threaded rods being passed through respective ones of the arm holders with their threads being in opposite directions; the transmission modules being connected to first ends of the threaded rods respectively; when motion is passed on to the threaded rods through the transmission modules, the threaded rods being moved to turn so as to make the arm holders move synchronously in either a same direction or opposite ones.

8. The cardboard box expanding and folding apparatus as recited in claim 7, wherein each of the transmission modules:

a first connecting rod; the first connecting rod being pivoted at one end thereof to said first end of a corresponding threaded rod;

a second connecting rod; the first connecting rod being pivoted at other end thereof to one end of the second connecting rod;

a first transmission belt;

a second transmission belt;

a transmission axle; the transmission axle being connected to the bed in a rotary manner; the second connecting rod being pivoted at other end thereof to the transmission axle; and a connecting axle with first and second turning wheels thereon; the connecting axle being disposed at a pivotal joint between the first and the second connecting rods; the first transmission belt being passed over the threaded rod, and passed over the first turning wheel of the connecting axle; the second transmission belt being passed over the second turning wheel of the connecting axle, and passed over the transmission axle; when the transmission axles are rotated, motion being positioned to pass on so as to cause rotational motion of the threaded rods through the first transmission belts, the connecting axles, and the second transmission belts.

9. The cardboard box expanding and folding apparatus as recited in claim 1, wherein each of the rotary members includes an eccentric rod, and a telescopic control element; each of the eccentric rods being fixedly joined to a respective one of the clamping arms at one end thereof, and pivoted at other end thereof to one end of a respective telescopic control element; the telescopic control elements each being connected to the bed at other end thereof; when the telescopic control elements are lengthening and shortening, motion will be passed on through the eccentric rods so as to make the clamping arms rotate.

10. The cardboard box expanding and folding apparatus as recited in claim 1, wherein the pushing unit of the conveying mechanism has a rod shape, and is fitted at one end thereof to the bed in a movable manner moving an expanded and folded cardboard box.

11. The cardboard box expanding and folding apparatus as recited in claim 1, wherein the conveying mechanism further includes:

two bearing portions for propping folded left and right parts of a bottom of a cardboard box, and a propping element for propping folded front and rear parts of a bottom of a box.

12. The cardboard box expanding and folding apparatus as recited in claim 11, wherein the propping element includes an upright plate part, and a bottom plate part perpendicular to the upright plate part; in use, the upright plate part passing through an aperture between folded left and right parts of a bottom of a cardboard box so as to prop folded front and rear parts of the bottom of the box.

13. The cardboard box expanding and folding apparatus as recited in claim 1 further having a tape applying device on a lateral side of one of the conveying belts; the tape applying device being positioned to apply a tape on folded left and right parts of a bottom of a cardboard box when the box is being moved through it, thus sealing the aperture between the folded left and right parts.

14. The cardboard box expanding and folding apparatus as recited in claim 1, wherein each of the rotary members includes:

left and right connecting rod assemblies, the left and the right connecting rod assemblies being pivoted at first ends thereof to the arm holders so as to move left and right, and up and down together with the arm holders; the left and the right connecting rod assemblies being pivoted to the bed at other ends thereof;

a left transmission assembly connected at a first end thereof to one of the clamping arms;

a right transmission assembly connected at a first end thereof to other one of the clamping arms; the left and the right transmission assemblies being connected together at second ends thereof;

a plurality of transmission wheels, the transmission wheels being fitted to the left and the right connecting rod assemblies; the left and the right transmission assemblies being connected to the transmission wheels so as to be supported on the left and the right connecting rod assemblies respectively; and a rotary driving element, the left and the right transmission assemblies being connected to the rotary driving element at the second ends thereof such that the left and the right transmission assemblies will be driven to rotate so as to cause rotational motion of a corresponding clamping arm by means of the rotary driving element.

15. The cardboard box expanding and folding apparatus as recited in claim 14, wherein each of the rotary driving elements includes a telescopic driving unit, and a little connecting rod; the telescopic driving unit being pivoted at one end thereof to a first end of the little connecting rod; the little connecting rod being connected at other end thereof to one of the left and the right transmission assemblies; thus, when the telescopic driving unit is lengthening and shortening, it will make the little connecting rod swing, and drive the left and the right transmission assemblies so as to rotate a corresponding clamping arm.

* * * * *